US005125574A

United States Patent [19]

Anderson et al.

[11] Patent Number: 5,125,574

[45] Date of Patent: Jun. 30, 1992

[54] ATOMIZING NOZZLE AND PROCESS

[75] Inventors: Iver E. Anderson, Ames, Iowa; Richard S. Figliola, Central, S.C.; Holly M. Molnar, Palm Bay, Fla.

[73] Assignee: Iowa State University Research Foundation, Ames, Iowa

[21] Appl. No.: 593,942

[22] Filed: Oct. 9, 1990

[51] Int. Cl.[5] ..... B22F 9/08

[52] U.S. Cl. ..... 239/8; 239/79; 239/397.5; 239/424.5; 239/433

[58] Field of Search ..... 239/8, 13, 79, 82, 85, 239/290, 296, 397.5, 423–424.5, 433, 434.5, 543, 544

[56] References Cited

U.S. PATENT DOCUMENTS

| | | | |
|---|---|---|---|
| 2,997,245 | 8/1961 | Nilsson et al. | 241/1 |
| 3,067,956 | 12/1962 | Tove | 241/1 |
| 3,141,194 | 7/1964 | Jester | 239/594 |
| 3,253,783 | 5/1966 | Probst et al. | 239/82 |
| 3,302,892 | 2/1967 | Nilsson | 241/1 |
| 3,387,783 | 6/1968 | Schellenberg et al. | 239/424 |
| 3,592,391 | 7/1971 | Bender et al. | 239/434.5 |
| 3,663,317 | 5/1972 | Westendorp et al. | 148/103 |
| 3,834,629 | 9/1974 | Hellman et al. | 239/594 |
| 4,575,325 | 3/1986 | Duerig et al. | 239/424 |
| 4,585,473 | 4/1986 | Narasimhan et al. | 75/0.5 C |
| 4,601,875 | 7/1986 | Yamamoto et al. | 419/23 |
| 4,619,845 | 10/1986 | Ayers et al. | 239/8 |
| 4,624,409 | 11/1986 | Takeda et al. | 239/424 |
| 4,664,724 | 5/1987 | Mizoguchi et al. | 148/302 |
| 4,801,340 | 1/1989 | Inoue et al. | 148/103 |
| 4,817,873 | 4/1989 | McKay | 239/397.5 |

OTHER PUBLICATIONS

I. E. Anderson et al., Fluid Flow Effects in Gas Atomization Processing, Oct. 1989.

R. S. Figliola et al., Flow Measurements in Gas Atomization Processes, 1989.

I. E. Anderson et al., Observations of Gas Atomization Process Dynamics, 1988.

E. J. Lavernia et al., Ultrasonic Gas Atomization, Apr. 1986.

V. Anand et al., Rapid Solidification of a Modified 7075 Aluminum Alloy by Ultrasonic Gas Atomization, 1981.

*Primary Examiner*—Andres Kashnikow
*Assistant Examiner*—Karen B. Meritt
*Attorney, Agent, or Firm*—Tilton, Fallon, Lungmus & Chestnut

[57] ABSTRACT

High pressure atomizing nozzle includes a high pressure gas manifold having a divergent expansion chamber between a gas inlet and arcuate manifold segment to minimize standing shock wave patterns in the manifold and thereby improve filling of the manifold with high pressure gas for improved melt atomization. The atomizing nozzle is especially useful in atomizing rare earth-transition metal alloys to form fine powder particles wherein a majority of the powder particles exhibit particle sizes having near-optimum magnetic properties.

24 Claims, 7 Drawing Sheets

$r_2 - r_0 = 2.5(r_1 - r_0)$

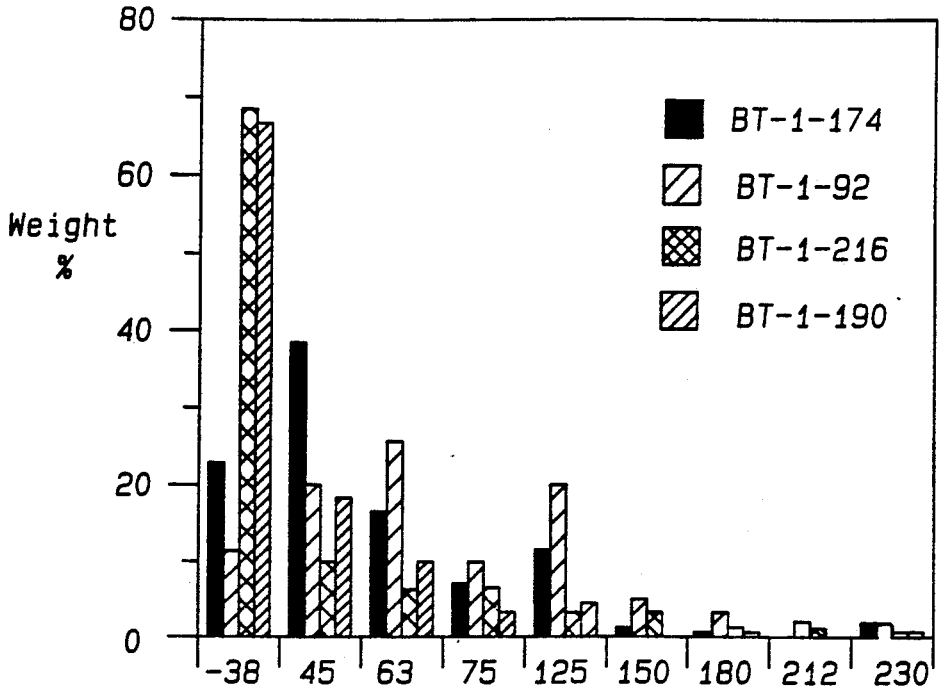
Fig-7 Particle Size (um)
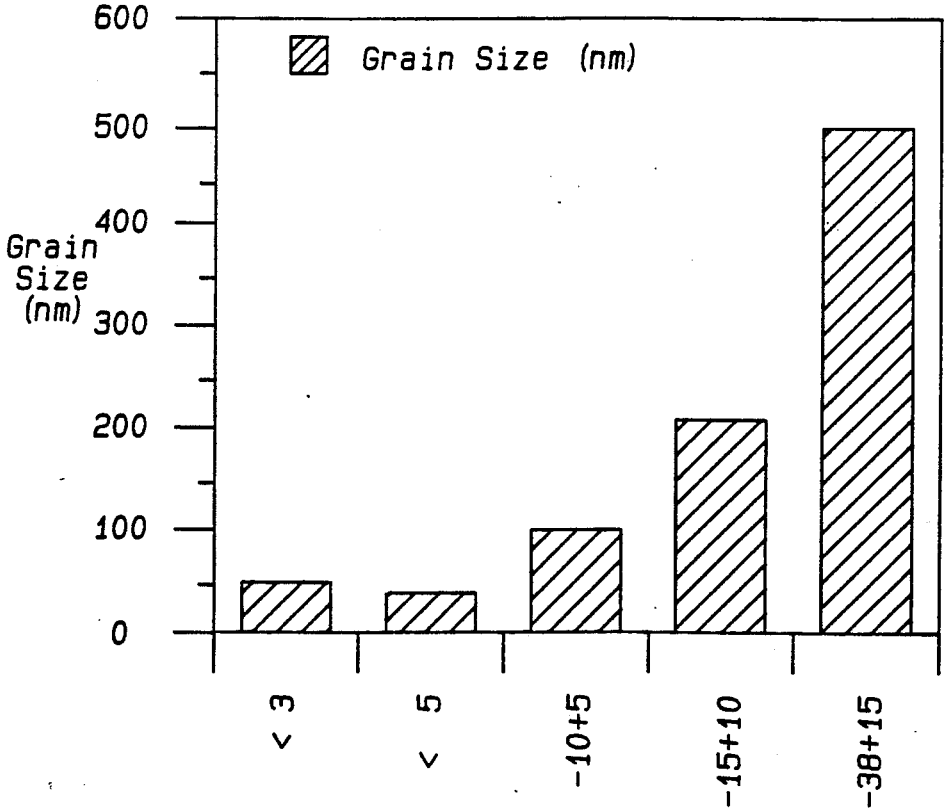
Fig-10 Particle Size (um)

ATOMIZING NOZZLE AND PROCESS

FIELD OF THE INVENTION

The present invention relates to the atomization of a melt to form fine powder particles and, more particularly, to an improved high pressure as atomizing nozzle and atomizing method using multiple discrete gas jets for atomizing a melt at elevated gas pressures.

BACKGROUND OF THE INVENTION

High pressure gas atomization (HPGA) as described in the Ayers and Anderson U.S. Pat. No. 4,619,845 issued Oct. 28, 1986, has shown considerable promise as a method of making very fine metal and alloy powder having a rapidly solidified microstructure with attendant control of alloyant segregation, grain size, supersaturation, and particle size, shape and distribution. The '845 patent describes atomization parameters required to effectively use the kinetic energy of supersonic (Mach 3 to 4) gas jet streams to disintegrate a melt into ultrafine, spherical powder particles. In particular, high pressure gas atomization in accordance with that patent employs an atomizing nozzle having multiple discrete, circumferentially spaced gas discharge orifices arranged about a nozzle melt supply tube having a central melt discharge orifice and adjacent frusto-conical surface. High pressure gas (typically an inert gas, such as argon, for reactive metals) is supplied to the gas discharge orifices for discharge in flush, laminar manner over the frusto-conical surface. The pressure of the gas supplied to the gas discharge orifices is selected at a high enough level (e.g., about 1800 psig) to establish a subambient pressure region immediately adjacent the melt discharge orifice to create an aspiration effect that draws melt out thereof for atomization at an apex region on the adjacent frusto-conical surface. The gas jet streams atomize the melt and form a narrow, supersonic spray containing very fine melt droplets that solidify rapidly as powder particles that are collected for further processing.

In addition to gas pressure, certain geometries/dimensions of the atomizing nozzle have been found to be important in achieving satisfactory atomization of the melt in the HPGA regime of operation. For example, the apex angle of the gas discharge orifices relative to the apex angle of the frusto-conical surface of the nozzle melt tube as well as the extension of the frusto-conical surface axially beyond the gas discharge orifices have been found to be important parameters that must be properly controlled and selected. Moreover, the orientation of the gas discharge orifices relative to the frusto-conical surface of the melt supply tube has also been found to be important. In particular, for optimum atomization, the gas discharge orifices should be flush with the frusto-conical surface and not offset therefrom. Detailed descriptions of the HPGA technique and the important parameters involved are set forth in the aforementioned patent and in the Anderson et al technical article (#1) "Fluid Flow Effects In Gas Atomization Processing", International Symposium on the Physical Chemistry of Powder Metals Production and Processing, TMS, Warrendale, Pa. (1989) and the Figliola et al technical article (#2) "Flow Measurements In Gas Atomization Processes", Synthesis and Measurements in Gas Processing: Characterization and Diagnostics of Ceramic and Metal Particulate Processing, TMS, Warrendale, Pa., pp. 39–47 (1989).

The second technical article referred to above describes modifications to certain geometries/dimensions of an original atomizing nozzle (developed by the Massachusetts Institute of Technology and described in its technical literature as an ultrasonic gas atomization nozzle) resulting in enhancement of the aspirating effect produced at the melt discharge orifice without affecting the location of the minimum pressure region relative thereto. In particular, the diameter of the melt supply tube was slightly enlarged to locate the gas discharge orifices flush with the frusto-conical surface adjacent the melt discharge orifice. An annular gas manifold was adopted although the gas jet ring diameter remained the same. The annular gas manifold was modified to have the gas discharge orifices communicate directly therewith rather via an intermediate annular manifold passageway as present in the M.I.T. device. The annular manifold was supplied with high pressure gas via a cylindrical conduit extending perpendicular to the manifold axis.

In attempting to atomize certain rare earth-transition metal magnetic alloys (e.g., rare earth-iron-boron alloys) using a gas atomizing nozzle modified as described in the aforementioned second technical article, the particular alloy chemistries involved were observed to adversely affect the atomization performance of the nozzle in so far as the particle sizes produced were distributed over a rather wide particle size range than expected, resulting in a higher than expected average particle size. In particular, a majority of the particle sizes produced were greater than an optimum particle size range (e.g., 3 to 44 microns, preferably 5 to 40 microns) where optimum magnetic properties are exhibited by the as-atomized particles for the particular alloy compositions involved. As a result, there is a need to further improve the performance of the gas atomizing nozzle in producing rare earth-transition metal magnetic alloy powder (e.g., rare earth-iron-boron alloy powder) to enable powder production with improved distribution of particle sizes in the optimum finer particle size range for the alloy compositions involved.

An object of the present invention is to provide a high pressure gas atomizing nozzle and atomizing method characterized by improved atomization performance.

Another object on the present invention is to provide an improved, efficient high pressure gas atomizing nozzle and atomizing method capable of producing rapidly solidified powder particles, especially of rare earth-transition metal alloys, wherein the percentage (yield) of particles falling within a desired fine particle size range for optimum properties (e.g., magnetic properties for the rare earth-transition metal alloys) is substantially increased so as to thereby increase the yield of the atomizing process.

Still another object of the present invention is to provide an improved, efficient high pressure gas atomizing nozzle and atomizing method capable of producing fine, rapidly solidified powder particles at a lower gas pressure, thereby reducing the quantity and supply pressure of the gas required and the cost of producing the powder particles.

SUMMARY OF THE INVENTION

The present invention involves an improved high pressure gas atomization nozzle and atomizing method of the type wherein a plurality of discrete gas jets are so directed at a nozzle surface at elevated gas pressure as to establish an aspiration effect adjacent a melt discharge orifice and produce a supersonic spray containing atomized melt droplets. The improved atomizing nozzle includes a gas manifold having a divergent first manifold chamber (expansion chamber) between a gas inlet and second manifold chamber to minimize formation and maximize dissipation of expansion shock waves in the high pressure gas introduced from the inlet to the manifold. The first manifold chamber (expansion chamber), in effect, minimizes wall reflection shock waves as the high pressure gas enters the manifold to avoid formation of standing shock waves therein that hinder uniform filling of the manifold with high pressure gas. The uniformity and extent of filling of the gas manifold with the high pressure gas is thereby substantially improved to enhance atomization performance of the nozzle.

The second manifold chamber preferably comprises an arcuate (partially annular) manifold segment having an inner radius $r_0$ and outer radius $r_1$ relative to a central axis of the manifold. The divergent manifold chamber has a dimension $r_2$ relative to the same central axis such that $r_2-r_0 \geqq 2(r_1-r_0)$, preferably $r_2-r_0 \delta 2.5\ (r_1-r_0)$.

The improved atomizing nozzle also includes improvements in the tangency of the gas jet discharge orifices to a nozzle central bore that receives a melt supply member (e.g., melt supply tube). The melt supply member includes a frusto-conical surface adjacent the melt discharge orifice. The improved tangency of the discharge orifices provides enhanced laminar flow of the gas jets or streams across the frusto-conical surface of the melt supply member to enhance the atomization performance of the nozzle. Moreover, the atomizing nozzle includes an increased number of gas discharge orifices disposed about a smaller diameter melt supply orifice to improve the uniformity of the gas curtain directed at the nozzle frusto-conical surface for atomization.

An improved two-piece melt supply member is provided for the atomizing nozzle to reduce melt freeze-up therein.

The present invention provides an improved atomizing nozzle and method for atomizing rare earth-transition metal alloys (e.g., rare earth-iron-boron) alloys into fine, rapidly solidified, generally spherical powder particles wherein the percentage (yield) of particles in the optimum size range for exhibiting magnetic properties in the as-atomized condition is substantially improved. For example, the weight percentage of particles having optimum magnetic properties is increased from about 25 weight % to greater than about 60 weight %, typically about 66–68 weight % of the atomized batch. Moreover, the improved atomization powder product is achieved at lower gas pressure as a result of the improved efficiency of the atomizing nozzle.

The aforementioned objects and advantages of the present invention will become more readily apparent from the following detailed description taken in conjunction with the drawings.

DESCRIPTION OF THE DRAWINGS

FIG. 7 is a bar graph illustrating the distribution in weight % of particles as a function of particle size (diameter).

FIG. 10 is a bar graph for Nd-Fe-B alloy particles illustrating particle grain size as a function of particle size.

DETAILED DESCRIPTION OF THE INVENTION

Figure 1:
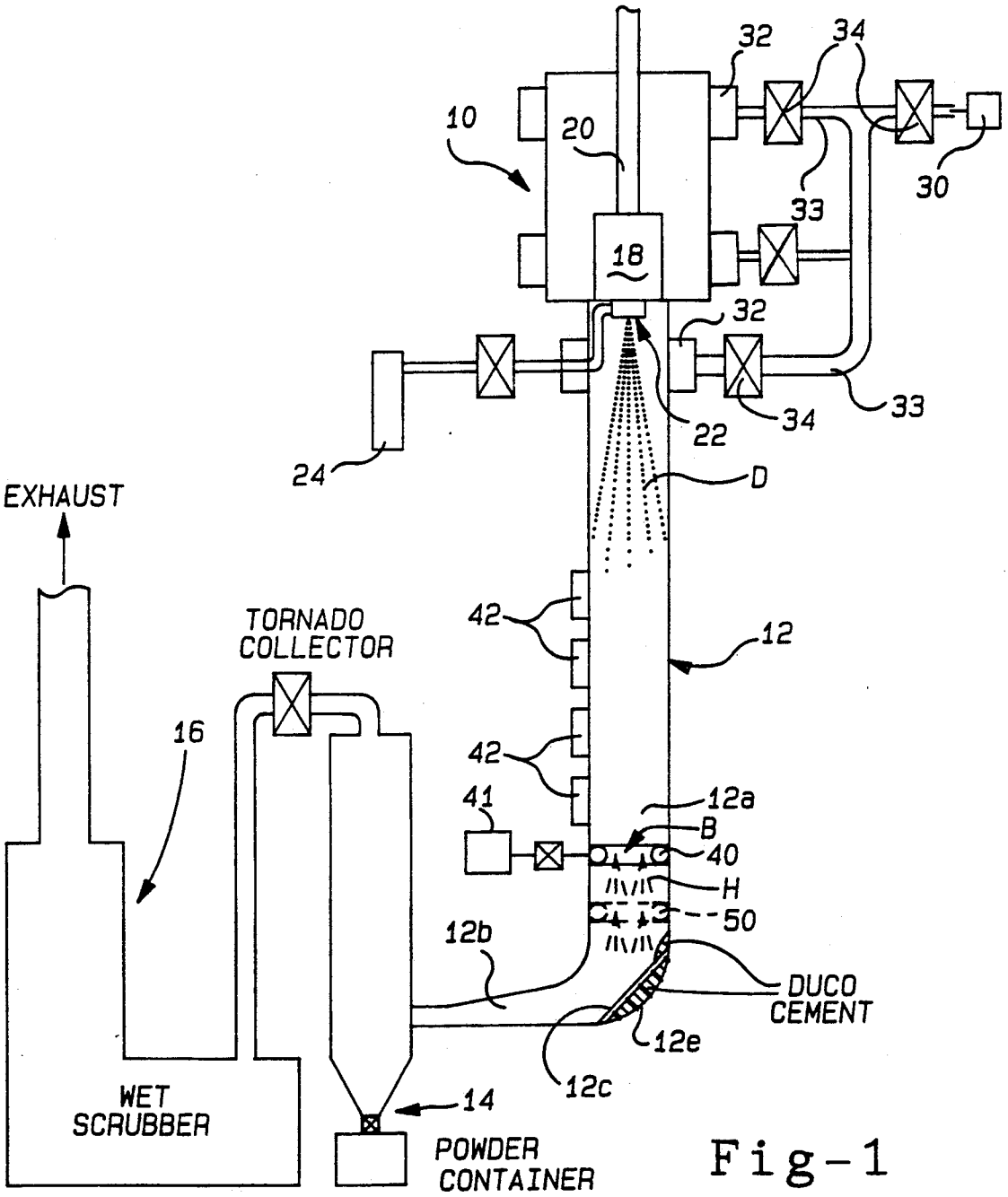
FIG. 1 is a schematic view of an atomizing apparatus including the atomizing nozzle of the invention.

Referring to FIG. 1, an atomization apparatus is shown for practicing one embodiment of the present invention where one or more environmentally protective layers are formed on the atomized particles in the apparatus in accordance with copending U.S. patent application "Environmentally Stable Reactive Alloy Powders And Method Of Making Same" Ser. No. 594,088. The present invention, however, is not limited to this embodiment wherein one or more protective layers are formed on the atomized powder particles in the atomization apparatus, and may be practiced to make uncoated as well as coated powder particles of various metals and alloys. The embodiment described herebelow wherein one or more protective layers are formed on the atomized powder particles is offered merely to illustrate one application of the invention in the production of powder particles. The improvements in atomization performance and particle size distributions described below by practicing the present invention are achievable irrespective of whether any protective layers are formed on the powder particles in the atomization apparatus.

The atomization apparatus includes a melting chamber 10, a drop tube 12 beneath the melting chamber, a powder collection chamber 14 and an exhaust cleaning system 16. The melting chamber 10 includes an induction melting furnace 18 and a vertically movable stopper rod 20 for controlling flow of melt from the furnace 18 to a melt atomizing nozzle 22 of the invention disposed between the furnace and the drop tube. The atomizing nozzle 22 is supplied with an inert atomizing gas (e.g., argon, helium) from a suitable source 24, such as a conventional bottle or cylinder of the appropriate gas. The atomizing nozzle 22 atomizes the melt in the form of a supersonic spray containing generally spherical, molten droplets D into the drop tube 12.

Both the melting chamber 10 and the drop tube 12 are connected to an evacuation device (e.g., vacuum pump) 30 via suitable ports 32 and conduits 33. Prior to melting and atomization of the melt, the melting chamber 10 and the drop tube 12 are evacuated to a level of $10^{-4}$ atmosphere to substantially remove ambient air. Then, the evacuation system is isolated from the chamber 10 and the drop tube 12 via the valves 34 shown and the chamber 10 and drop tube 12 are positively pressurized by an inert gas (e.g., argon to about 1.1 atmosphere) to prevent entry of ambient air thereafter.

The drop tube 12 includes a vertical drop tube section 12*a* and a lateral section 12*b* that communicates with the powder collection chamber 14. The drop tube vertical section 12*a* has a generally circular cross-section having a diameter in the range of 1 to 3 feet, a diameter of 1 foot being used in the Examples set forth below. The diameter of the drop tube section 12*a* and the diameter of an optional reactive gas jet 40 are selected in relation to one another to provide a reactive gas zone or halo H extending substantially across the cross-section of the drop tube vertical section 12*a* at the zone H.

The length of the vertical drop tube section 12*a* is typically about 9 to about 16 feet, a preferred length being 9 feet being used in the Examples set forth below, although other lengths can be used in practicing the invention. A plurality of temperature sensing means 42 (shown schematically), such as radiometers or laser doppler velocimetry devices, may be spaced axially apart along the length of the vertical drop section 12*a* to measure the temperature of the atomized droplets D as they fall through the drop tube and cool in temperature.

The optional reactive gas jet 40 referred to above is disposed at location along the length of the vertical drop section 12*a* where the falling atomized droplets D have cooled to a reduced temperature (compared to the droplet melting temperature) at which the droplets have at least a solidified exterior surface thereon and at which the reactive gas in the zone H can react with one or more reactive alloying elements of the shell to form a protective barrier layer (reaction product layer comprising a refractory compound of the reactive alloying element) on the droplets whose depth of penetration into the droplets is controllably limited by the presence of the solidified surface as will be described below.

In particular, the jet 40 is supplied with reactive gas (e.g., nitrogen) from a suitable source 41, such as a conventional bottle or cylinder of appropriate gas, through a valve and discharges the reactive gas in a downward direction into the drop tube to establish the zone or halo H of reactive gas through which the droplets travel and come in contact for reaction in-situ therewith as they fall through the drop tube. The reactive gas is preferably discharged downwardly in the drop tube to minimize gas updrift in the drop tube 12. The flow patterns established in the drop tube by the atomization and falling of the droplets inherently oppose updrift of the reactive gas. As a result, a reactive gas zone or halo H having a more or less distinct upper boundary B and less distinct lower boundary extending to the collection chamber 14 is established in the drop tube section 12*a* downstream from the atomizing nozzle in FIG. 1. As mentioned above, the diameter of the drop tube section 12*a* and the jet 40 are selected in relation to one another to establish a reactive gas zone or halo that extends laterally across the entire drop tube cross-section. This places the zone H in the path of the falling droplets D so that substantially all of the droplets travel therethrough and contact the reactive gas.

The temperature of the droplets D as they reach the reactive gas zone H will be low enough to form at least a solidified exterior surface thereon and yet sufficiently high as to effect the desired reaction between the reactive gas and the reactive alloying element(s) of the droplet composition. The particular temperature at which the droplets have at least a solidified exterior shell will depend on the particular melt composition, the initial melt superheat temperature, the cooling rate in the drop tube, and the size of the droplets as well as other factors such as the "cleanliness" of the droplets, i.e., the concentration and potency of heterogeneous catalysts for droplet solidification.

The temperature of the droplets when they reach the reactive gas zone H will be low enough to form at least a solidified exterior skin or shell of a detectable, finite shell thickness; e.g., a shell thickness of at least about 0.5 micron. Even more preferably, the droplets are solidified from the exterior surface substantially to the droplet core (i.e., substantially through their diametral cross-section) when they reach the reactive gas zone H. As mentioned above, radiometers or laser doppler velocimetry devices, may be spaced axially apart along the length of the vertical drop section 12*a* to measure the temperature of the atomized droplets D as they fall through the drop tube and cool in temperature, thereby sensing or detecting when at least a solidified exterior shell of finite thickness has formed on the droplets. The formation of a finite solid shell on the droplets can also be readily determined using a physical sampling technique in conjunction with macroscopic and microscopic examination of the powder samples taken at different axial locations downstream from the atomizing nozzle in the drop tube 12.

Referring to FIG. 1, prior to atomization, a thermally decomposable organic material can optionally be deposited on a splash member 12*c* disposed at the junction of the drop tube vertical section 12*a* and lateral section 12*b* to provide sufficient carbonaceous material in the drop tube sections 12*a*, 12*b* below zone H as to form a carbon-bearing (e.g., graphite layer) on the hot droplets D after they pass through the reactive gas zone H. The organic material may comprise an organic cement to hold the splash member 12*c* in place in the drop tube 12. Alternately, the organic material may simply be deposited on the upper surface or lower surface of the splash member 12*c*. In any event, the material is heated during atomization to thermally decompose it and release gaseous carbonaceous material into the sections 12*a*, 12*b* below zone H. An exemplary organic material for use comprises Duco® model cement that is applied in a uniform, close pattern to the bottom of the splash member 12*c* to fasten it to the elbow 12*e*. Also, the Duco cement is applied as a heavy bead along the exposed uppermost edge of the splash member 12*c* after the initial fastening to the elbow. The Duco cement is subjected during atomization of the melt to temperatures in excess of 500° C. so that the cement thermally decomposes and acts as a source of gaseous carbonaceous material to be released into drop tube sections 12*a*, 12*b* beneath the zone H. The extent of heating and thermal decomposition of the cement and, hence, the concentration of carbonaceous gas available for powder coating is controlled by the position of the splash member 12*c*, particularly the exposed upper most edge, relative to the initial melt splash impact region and the central zone of the spray pattern. To maximize the extent of heating and thermal decomposition, additional Duco cement can be laid down (deposited) as stripes on the upper surface of the splash member 12*c*.

Alternately, a second optional jet 50 can be disposed downstream of the first supplemental reactive gas jet 40. The second jet 50 is adapted to receive a carbonaceous material, such as methane, argon laced with paraffin oil and the like, from a suitable source (not shown) for discharge into the drop tube section 12*a* to form a graphitic carbon coating on the hot droplets D after they pass through the reactive gas zone H.

Powder collection is accomplished by separation of the powder particles/gas exhaust stream in the tornado centrifugal dust separator/collection chamber 14 by retention of separated powder particles in the valved powder-receiving container, FIG. 1.

Figure 2:
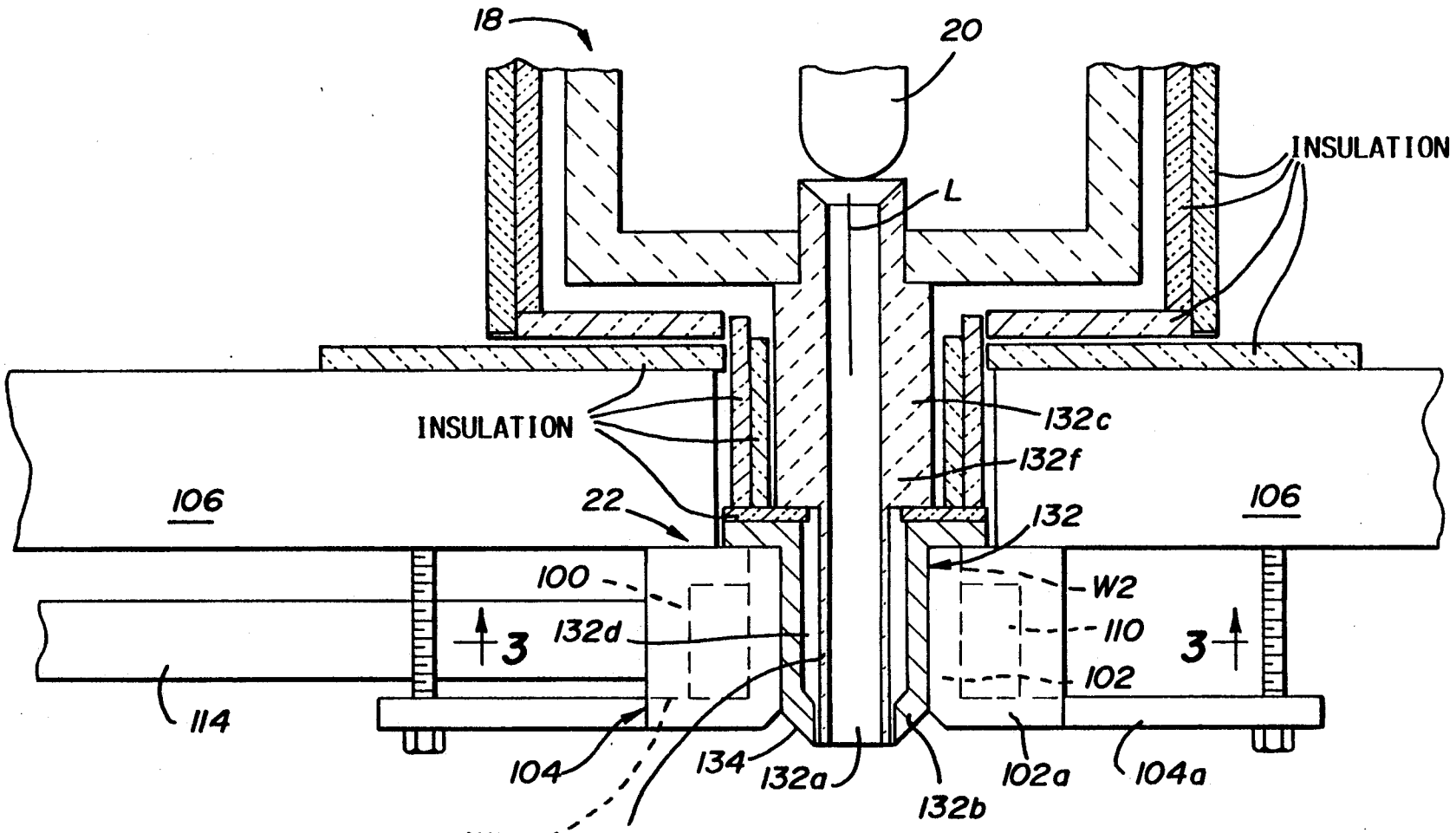
FIG. 2 is a side elevation of an atomizing nozzle in accordance with one embodiment of the invention.

In accordance with the invention, the atomizing nozzle 22 comprises a first annular nozzle body member 100 and second annular nozzle body member 102 welded together at W1, W2 to provide a nozzle body 104. As shown best in FIG. 2, a large diameter separation/chill plate 106 is disposed above the nozzle body 104. The plate 106 includes a plurality (e.g., 3) of circumferentially spaced screw receiving holes (not shown) to receive screws by which the plate 106 and nozzle body mounting plate 104*a* are positioned relative to the bottom of the induction melting furnace 18, FIG. 2. Mounting plate 104*a* is welded to the nozzle body 104.

Figure 3:
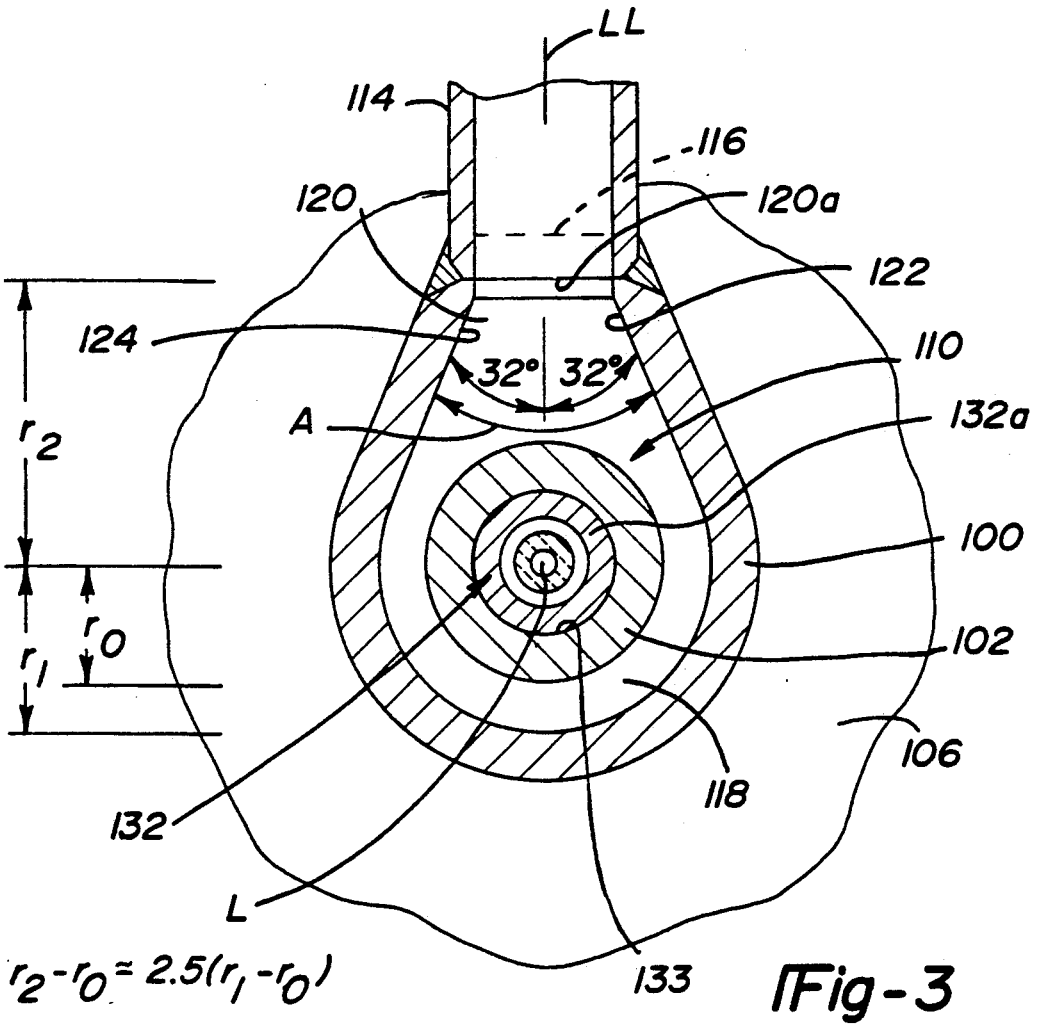
FIG. 3 is a view of the atomizing nozzle along lines 3—3.

The first and second nozzle body members 100, 102 define therebetween a generally annular, vertically elongated gas manifold 110 that extends along the vertical, central axis L of the manifold 110. The gas manifold 110 receives high pressure gas (e.g., typically argon or helium) from the source 24, such as a conventional (6000 psi) bottle or cylinder of appropriate gas, via a gas supply conduit 114 and a gas inlet 116 formed on the nozzle body 104. In particular, the gas supply conduit 114 extends from the gas source 24 to the gas inlet 116 where the conduit is welded in the gas inlet 116 as shown in FIG. 3 so as to provide a leakproof connection to avoid high pressure gas leakage.

Disposed between the gas inlet 116 and a constant cross-section, arcuate manifold segment 118 (second manifold chamber) is a divergent first expansion region or chamber 120 (first manifold chamber) that functions to minimize formation and maximize dissipation of expansion shock waves in the high pressure gas introduced from the gas inlet 116 to the manifold. The divergent first manifold chamber 120 is configured and dimensioned to this end. In particular, the divergent chamber 120 comprises first and second diverging walls 122, 124 that are machined in the nozzle body member 100 along the vertical length thereof. The walls 122, 124 each diverge at an angle of between about 20 to about 45°, preferably about 32 degrees, relative to the central axis LL of the gas inlet 116 as shown best in FIG. 3. The first and second walls 122, 124 thereby define an included angle A therebetween. Preferably, the included angle A is 64°. Moreover, the inner and outer radii re and $r_1$ of the arcuate second manifold chamber 118 relative to the vertical, central axis L of the manifold 110 and the distance $r_2$ of the manifold inlet wall 120*a* relative to the axis L are selected in a particular relationship to this same end. Generally, $r_0$, $r_1$ and $r_2$ are selected in accordance with the relationship, $r_2-r_0 \geqq 2(r_1-r_0)$. Preferably, $r_0$, $r_1$ and $r_2$ are selected in accordance with the relationship $r_2-r_0 \delta 2.5(r_1-r_2)$ to achieve optimum functioning of the expansion region or chamber 120; i.e., minimization of wall reflection shock waves as the high pressure gas enters the manifold to avoid formation of standing shock waves therein that hinder uniform filling of the manifold with high pressure gas. In this way, the uniformity and extent of filling of the gas manifold with the high pressure gas is thereby substantially improved to enhance atomization performance of the nozzle 22. The above-described relationships of $r_0$, $r_1$ and $r_2$ are based on a two-dimensional analysis of the high pressure gas flow into the gas manifold 110.

Figure 4:
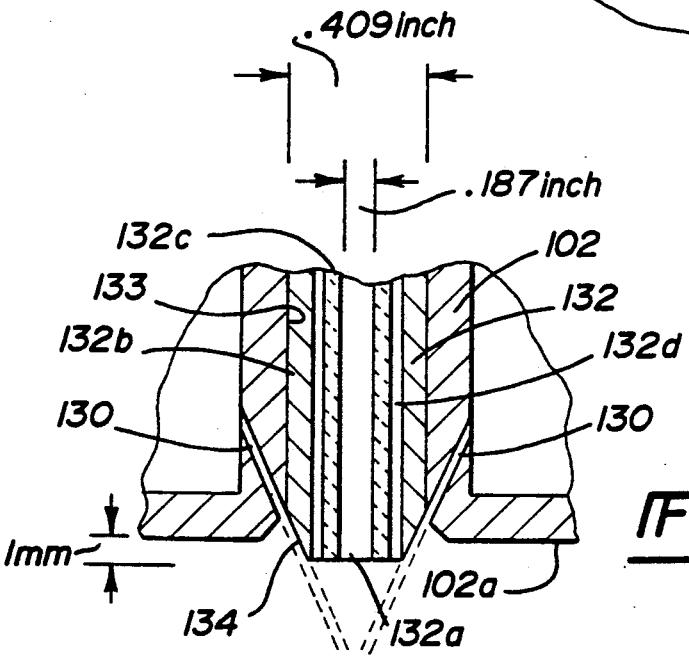
FIG. 4 is a fragmentary sectional view of the atomizing nozzle showing gas jet discharge orifices aligned with the melt supply tube frusto-conical surface.

The high pressure gas flows from the gas manifold 110 through a plurality of gas jet discharge orifices 130 spaced circumferentially apart about a nozzle melt supply member (tube) 132 having a central melt discharge orifice 132*a*. The melt supply tube 132 is received in a central cylindrical bore 133 of the nozzle body 104. The gas discharge orifices 130 define an apex angle AA that preferably coincides with the apex angle of the frusto-conical surface 134 of the nozzle melt supply tube 132; namely, 45 degrees as shown in FIG. 4.

The melt supply member 132 preferably comprises an outer, tubular, metallic, (e.g., Type 304 stainless steel) member 132*b*, and an inner refractory tubular member 132*c* spaced apart by thermal insulating air space 132*d* to reduce the prospect of melt freeze-up in the melt supply member. The refractory tubular member 132*c* includes laterally extending, annular flange 132*f* disposed on an annular shoulder of the outer tubular member 132*b*. The outer, metallic tubular member 132*b* resists erosion at the surface 134. The refractory tubular member 132*c* may comprise boron nitride, machinable alumina, or graphite. The former (BN) is used in atomizing rare earth-transition metal alloys. The refractory tubular member 132*c* defines the melt discharge orifice 132*a* axially therethrough.

To further help in preventing melt freeze up, a cylindrical, tubular, metallic heat-reflector (not shown) or electrical heating device (not shown) can be disposed in the space 132*d* concentric with axis L.

In accordance with the present invention, the number of gas jet discharge orifices 130 is increased compared to the number used heretofore; e.g., as described in U.S. Pat. No. 4,619,845 and the technical articles #1 and #2 referred to above in the Background of the Invention. For example, the number of discharge orifices 130 is increased from 18 to 20 while at the same time reducing the individual orifice diameter from 0.0310 inch to 0.0292 inch so as to maintain the same total discharge orifice exit area. In this way, the uniformity of the curtain of high pressure gas directed on the frusto-conical surface 134 of the nozzle melt feed tube 132 is enhanced.

Figure 5:
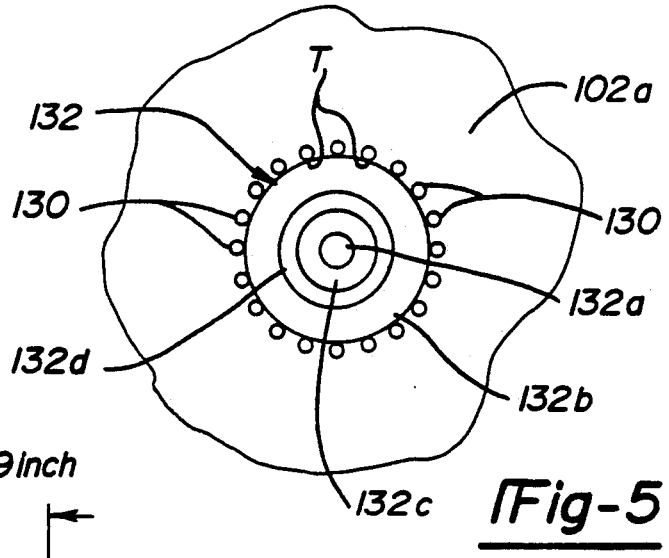
FIG. 5 is a bottom elevation of the atomizing nozzle.

In addition to increasing the number of gas jet discharge orifices 130, the present invention substantially improves the tangency T, FIG. 5, of the discharge orifices 130 relative to the central bore 133 of the nozzle body 104 to about 0.002 inch, preferably about 0.001 inch, in order to enhance laminar flow of the high pressure gas jets or streams over the frusto-conical surface 134. Laminar flow is known to be an important parameter in the atomization performance of the nozzle 22; e.g., see the aforementioned technical articles #1 and #2 referred to above. Improvement of the tangency T of the discharge orifices 130 to the central bore 133 allows orientation of the discharge orifices 130 in a more flush manner than has been possible with previous atomizing nozzles wherein the tangency of the discharge orifices 130 to the central bore 133 was typically in the range of 0.004 to 0.005 inch and varied from one discharge orifice to another around the bore 133. The improved tangency of the discharge orifices 130 to the bore 133 in conjunction with a slight reduction in the size of the inner diameter of the melt supply discharge orifice 132*a* from 0.209 inch to preferably 0.187 inch contributes to improved atomization performance with respect to rare earth-transition metal alloys described below. The orifice 132*a* may have a diameter between about 0.209 inch to about 0.150 inch.

Figure 6:
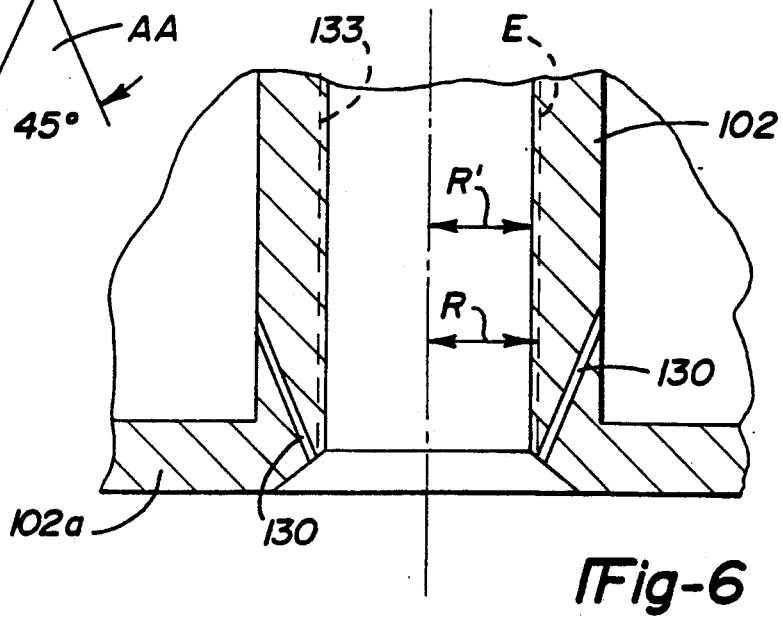
FIG. 6 is a fragmentary sectional view of the nozzle melt supply tube after the gas discharge orifices are machined therein but before the final diameter of the central bore is machined.

In accordance with the invention, tangency of the discharge orifices 130 to the central bore 133 is substantially improved by first machining the bore 133 in the nozzle body member 102 to an initial, undersized lateral dimension (i.e., radius R') as shown in FIG. 6, then machining the discharge orifices 130 in the body member 102, and finally machining the central bore 133 to final, lateral dimension (i.e., radius R) by removing the envelope E of metal from the undersized initial bore. This particular machining sequence is carried out on a numerically controlled (NC) machine tool, such as an NC vertical milling machine available from Bridgeport.

The improved atomizing nozzle 22 described above is operable to atomize a melt in the manner described in U.S. Pat. No. 4,619,845 and the aforementioned technical articles #1 and #2 by formation of a supersonic spray containing fine molten droplets, the teachings of which are incorporated herein by reference to this end.

Importantly, the improved atomizing nozzle 22 described above is capable of producing rapidly solidified powder particles, especially of rare earth-transition metal alloys, wherein the percentage (yield) of particles falling within a desired fine particle size range for optimum properties (e.g., magnetic properties for the rare earth-transition metal alloys) is substantially increased so as to thereby increase the yield of the atomizing process. The atomizing nozzle 22 of the invention is especially useful in atomizing rare earth-transition metal alloys that demonstrate desirable magnetic properties. The rare earth-transition metal alloys typically include, but are not limited to, Tb-Ni, Tb-Fe and other refrigerant magnetic alloys and rare earth-iron-boron alloys described in U.S. Pat. Nos. 4,402,770; 4,533,408; 4,597,938 and 4,802,931, the teachings of which are incorporated herein by reference, where the rare earth is selected from one or more of Nd, Pr, La, Tb, Dy, Sm, Ho, Ce, Eu, Gd, Er, Tm, Yb, Lu, Y and Sc. Lower weight lanthanides (Nd, Pr, La, Sm, Ce, Y, Sc) are preferred. Rare earth-iron-boron alloys, especially Nd-Fe-B alloys comprising about 26 to 36 weight % Nd, about 62 to 68 weight % Fe and about 0.8 to 1.6 weight % B, are particularly adapted for atomization in accordance with the invention.

Nd-Fe-B alloys rich in Nd (e.g., at least about 27 weight %) and rich in B (e.g., at least about 1.1 weight %) are preferred to promote formation of the hard magnetic phase, $Nd_2Fe_{14}B$, in an equiaxed, blocky microstructure, and minimize, preferably avoid, formation of the ferritic Fe phase in all particle sizes produced. The Nd-Fe-B alloys rich in Nd and B were found to be substantially free of primary ferritic phase when atomized in accordance with the invention, whereas the ferritic phase was observed in some particle sizes (e.g., 10 to 20 microns) for Fe rich and near-stoichiometric alloy compositions similarly atomized. Alloyants such as Co, Ga, La and others may be included in the alloy composition, such as 31.5 weight % Nd- 65.5 weight % Fe- 1.408 weight % B- 1.592 weight % La and 32.6 weight % Nd- 50.94 weight % Fe- 14.1 weight % Co- 1.22 ;weight % B- 1.05 weight % Ga.

With Nd-Fe-B type alloys, the Nd content of the alloy was observed to be decreased by about 1-2 weight % in the atomized powder compared to the melt as a result of melting and atomization, probably due to reaction of the Nd during melting with residual oxygen and formation of a moderate slag layer on the melt surface. The iron content of the powder increased relatively as a result while the boron content remained generally the same. The initial melt composition can be adjusted to accommodate these effects.

The following Examples are offered to further illustrate, but not limit, the present invention.

EXAMPLE 1

The melting furnace of FIG. 1 was charged with and Nd-Fe master alloy as prepared by thermite reduction, an Fe-B alloy carbon-thermic processed and obtained from Shieldalloy Metallurgical Corp. and electrolytic iron from Glidden Co. The charge was melted in the induction furnace after the melting chamber and the drop tube were evacuated to $10^{-4}$ atmosphere and then pressurized with argon to 1.1 atmosphere to provide a melt of the composition 28 weight % Nd, 70.9 weight % Fe and 1.1 weight % B. The melt was heated to a temperature of 1650° C. and supplied upon raising of the stopper rod to an atomizing nozzle of the prior art type used heretofore having an annular gas manifold fed high pressure argon via a suitable conduit. The gas manifold did not include a first manifold expansion chamber between the gas inlet and a second manifold chamber. Eighteen gas jet discharge orifices were present and defined an apex angle of 45 degrees that was equal to the apex angle of the frusto-conical surface of the nozzle melt supply tube. The discharge orifices were located as flush as possible to the frusto-conical surface given that they typically exhibited a tangency to the central bore of the nozzle body of about 0.004 to 0.005 inch which varied from one orifice to another. The diameter of the melt discharge orifice 132*a* was 0.209 inch.

Argon atomizing gas at 1750 psig was supplied to the atomizing nozzle. A reactive gas jet was located 75 inches downstream from the nozzle in the drop tube. Ultra high purity (99.995%) nitrogen gas was supplied to the jet at a pressure of 100 psig for discharge into the drop tube to establish a nitrogen gas reaction zone or halo extending across the drop tube such that substantially all the atomized droplets traveled through the zone. At this location downstream from the nozzle, the droplets were determined to be at a temperature of about 1000° C. or less, where at least a finite thickness solidified exterior shell was present thereon to control formation a protective reaction product layer on the particles in accordance with the teachings of copending U.S. patent application "Environmentally Stable Reactive Alloy Powders And Method Of Making Same" Ser. No. 594,088, the teachings of which are incorporated herein by reference.

After the atomized droplets traveled through the reaction zone, they were collected in the collection container of the collection chamber (e.g., see FIG. 1). The solidified powder product was removed from the collection chamber when the powder reached approximately 22° C. The powder collected was then size classified by sifting the powder through a full series of ASTM woven wire screens and by an automated size analysis technique based on laser light scattering by an ensemble of particles dispersed in a transparent fluid to determine the particle size distribution in the batch collected. The results of the size classification are shown in FIG. 7 under the designation BT-1-92 where it is evident that about 20 weight % of the particles were 125 microns in diameter, about 10 weight % were 75 microns in diameter, about 22.5 weight % were 63 microns in diameter, about 20 weight % were 45 microns in diameter and about 11 weight % were less than 38 microns in diameter. It is apparent that a majority of the particles are 63 microns and greater.

EXAMPLE 2

The melting furnace of FIG. 1 was charged in a similar manner to Example 1 with an Nd-16 weight % Fe master alloy as prepared by thermite reduction, an Fe-B alloy carbo-thermic processed and obtained from the Shieldalloy Metallurgical Corp. and electrolytic Fe obtained from Glidden Co. The charge was melted in the induction furnace after the melting chamber and the drop tube were evacuated to $10^{-4}$ atmosphere and then pressurized with argon to 1.1 atmosphere to provide a melt of the composition 31.51 weight % Nd, 65.49 weight % Fe, 1.408 weight % B, and 1.597 weight % La. The melt was heated to a temperature of 1650° C. After a hold period of 10 minutes to reduce (vaporize) Ca present in the melt (from the thermite reduced master alloy) to melt levels of 50–60 ppm by weight, the melt was fed to the atomizing nozzle 22 of the invention upon raising of the stopper rod.

The particular atomizing nozzle 22 used had an $r_0$ of 0.3295 inch, $r_1$ of 0.455 inch and $r_2$ of 0.642 inch. The diameter of the manifold wall (120*a*) was 0.375 inch with the inner diameter of the gas supply conduit (112) also being 0.375 inch. The walls of the divergent manifold chamber defined a 64° included angle. The diameter of melt discharged orifice 132*a* was 0.187 inch. In other respects, the atomizing nozzle used was as described above; e.g., 20 discharge orifices of 0.0292 inch diameter defining a 45° apex angle with tangency of about 0.001 inch to the central bore 133.

Argon atomizing gas at 1100 psig was supplied to the atomizing nozzle 22. A reactive gas jet was located 75 inches downstream from the nozzle in the drop tube. Ultra high purity (99.995%) nitrogen gas was supplied to the jet at a pressure of 100 psig for discharge into the drop tube to establish a nitrogen gas reaction zone or halo extending across the drop tube such that substantially all the atomized droplets traveled through the zone. At this location downstream from the nozzle, the droplets were determined to be at a temperature of about 1000° C or less, where at least a finite thickness solidified exterior shell was present thereon to control formation a protective reaction product layer on the particles in accordance with the teachings of the aforementioned copending U.S. patent application "Environmentally Stable Reactive Alloy Powders And Method Of Making Same" Ser. No. 594,088.

After the atomized droplets traveled through the reaction zone, they were collected in the collection container of the collection chamber (e.g., see FIG. 1). The solidified powder product was removed from the collection chamber when the powder reached approximately 22° C. The powder collected was then size classified by passing the powder through a series of ASTM woven wire screens and by the automated size analysis to determine the particle size distribution in the batch collected. The results of the size classification are shown in FIG. 7 under the designation BT-1-190 where it is evident that about 2 weight % of the particles were 125 microns in diameter, about 2 weight % were 75 microns in diameter, about 4 weight % were 63 microns in diameter, about 18 weight % were 45 microns in diameter, and about 64–65 weight % were less than 38 microns in diameter. It is apparent that a majority of the particles are less than 38 microns in diameter.

EXAMPLE 3

A melt comprising 33.07 weight % Nd, 63.93 weight % Fe, 1.32 weight B and 1.68 weight % La was melted and atomized in a manner similar to that described in Example 2. The results of the size classification are shown in FIG. 7 under the designation BT-1-216 where it is evident that about 2 weight % of the particles were 125 microns in diameter, about 3–4 weight % were 75 microns in diameter, about 3–4 weight % were 63 microns in diameter, about 10 weight % were 45 microns in diameter, and about 66–68 weight % were less than 38 microns in diameter. It is apparent that a majority of the particles are less than 38 microns in diameter.

Figure 8:
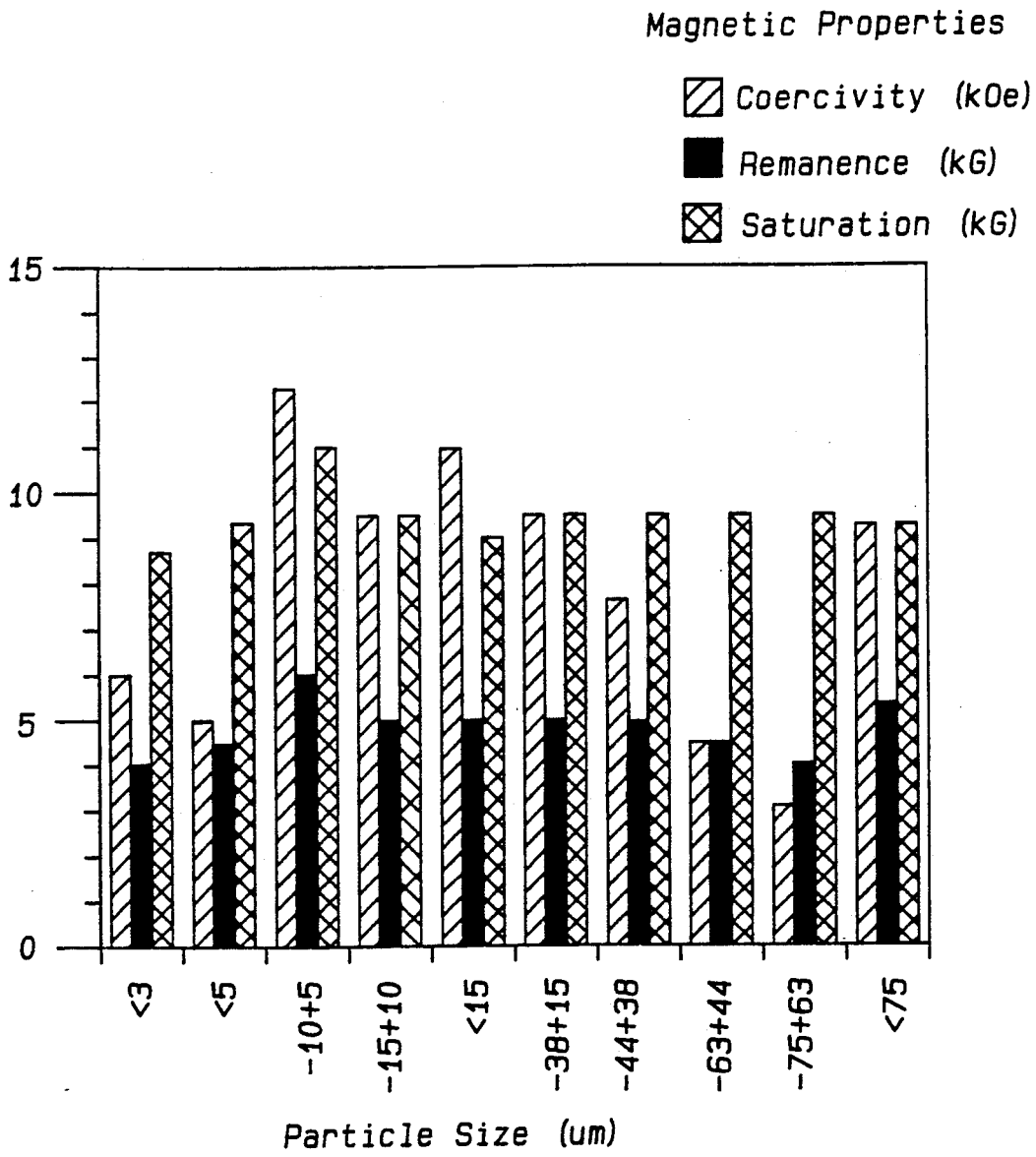
FIG. 8 is a bar graph of illustrating the magnetic properties of as-atomized Nd-Fe-B alloy particles as a function of particle size.
Figure 9:
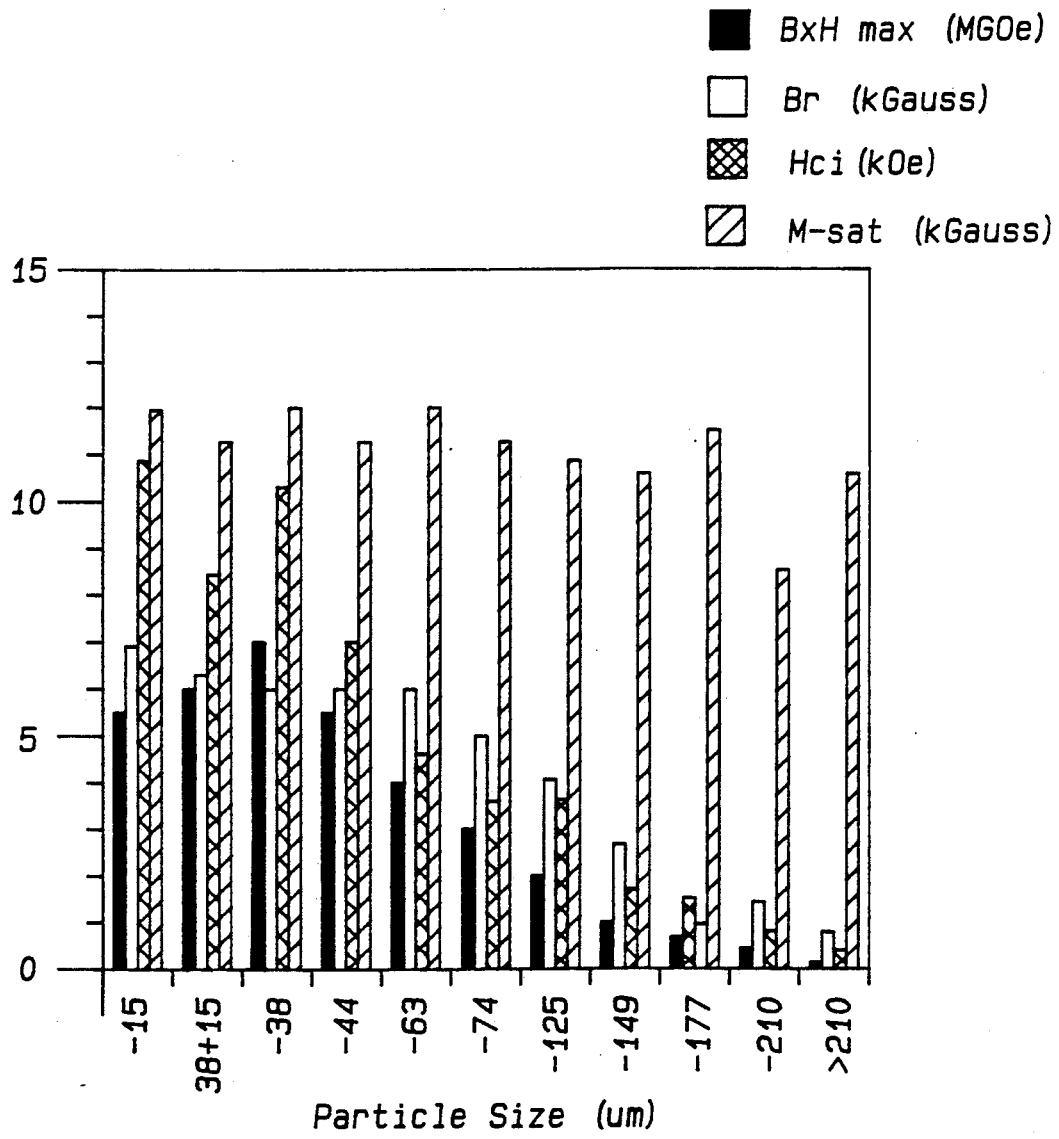
FIG. 9 is a similar bar graph for Nd-Fe-B-La particles.

The advantage of producing the alloy powder in the manner described wherein a majority of the particles are less than 38 microns in diameter is evident in FIGS. 8 and 9. In these Figures, the magnetic properties (namely, coercivity, remanence and saturation) of as-atomized powder as a function of particle size is set forth for the aforementioned alloy BT-1-190 and another alloy BT-1-162 (32.5 weight % Nd-66.2 weight % Fe-1.32 weight % B ). The alloy BT-1-162 was atomized in a manner similar to that of Examples 2–3. The Figures demonstrate that coercivity and, to a lesser extent, remanence appear to vary as a function of particle size in both alloys. Elevated levels of coercivity and remanence are observed in both alloys as particle size (diameter) is reduced below about 38 microns. On the other hand, saturation magnetization of both alloys remains relatively constant over the range of particle sizes. For alloy BT-1-162, the coercivity falls significantly as particle size is reduced below about 5 microns. These results correlate with grain size measurements which reveal a continuous decrease in grain size with reduced particle size; e.g., from a grain size of about 500 nm for 15–38 micron particles to about 40–70 for less than 5 micron particles; for example, as shown in FIG. 10 for alloy BT-1-162 Magnetic property differences between powder size classes were due to differences in the microcrystalline grain size within each particle class.

It is apparent that near optimum overall magnetic properties are exhibited by the as-atomized alloy particles in the general particle size (diameter) range of about 3 to about 44 microns and, more particularly, about 5 to about 40 microns where the majority of the particles are produced by practice of the invention. Thus, the yield of as-atomized powder particles possessing useful magnetic properties is significantly enhanced in practicing the invention. Moreover, as is apparent from the Examples, these results are achieved at lower gas pressure.

While the invention has been described in terms of specific embodiments thereof, it is not intended to be limited thereto but rather only to the extent set forth hereafter in the following claims.

We claim:

1. A high pressure gas atomizing nozzle for atomizing a melt, comprising:

a) a melt supply member, b) a gas manifold for receiving high pressure gas, said manifold comprising a gas inlet in communication with a source of high pressure gas, a divergent first manifold chamber in communication with the gas inlet, and a second manifold chamber in communication with said divergent manifold chamber, said first manifold chamber diverging from the gas inlet toward the second manifold chamber, and c) a plurality of discrete gas discharge orifices disposed around the melt supply member and in communication with the manifold for discharging high pressure gas streams to atomize said melt.

2. The nozzle of claim 1 wherein said second manifold chamber comprises a constant cross-section, arcuate manifold chamber.

3. The nozzle of claim 2 wherein the arcuate manifold chamber has an inner radius $r_0$ and an outer radius $r_1$ relative to a central axis of said manifold, and said expansion chamber has a dimension $r_2$ relative to said central axis wherein $r_2-r_0 \geqq 2(r_1-r_0)$.

4. The nozzle of claim 3 wherein $1_2-r_0\delta 2.5(r_1-r_0)$.

5. The nozzle of claim 1 wherein the gas manifold is disposed in a nozzle body having a bore that receives said melt supply member.

6. The nozzle of claim 5 wherein the gas discharge orifices each intersect the bore at a tangency thereto not exceeding 0.002 inch.

7. The nozzle of claim 6 wherein the tangency of said discharge orifices does not exceed 0.001 inch.

8. The nozzle of claim 1 wherein the expansion chamber diverges at an included angle of about 40° to about 90°.

9. The nozzle of claim 8 wherein the included angle is about 64 degrees.

10. In a method of atomizing a rare earth-transition metal alloy melt by supplying high pressure gas to a gas manifold communicating to a plurality of discrete gas discharge orifices disposed around a melt supply member, the improvement comprising supplying the high pressure gas to a gas manifold having a divergent first manifold chamber disposed between a manifold gas inlet and a second manifold chamber communicating to said orifices, said first manifold chamber diverging from said gas inlet toward said second manifold chamber so as to reduce standing shock wave patterns in said manifold and thereby improve filling of said manifold with the high pressure gas that is discharged from the discharge orifices for atomizing the melt.

11. The method of claim 10 wherein the high pressure gas is supplied to gas discharge orifices that each intersect a melt supply member-receiving bore at a tangency thereto not exceeding 0.002 inch.

12. The method of claim 11 wherein the tangency of said discharge orifices does not exceed 0.001 inch.

13. The method of claim 10 wherein the high pressure gas is supplied form the divergent manifold chamber to the second manifold chamber having an inner radius $r_0$ and an outer radius $r_1$ relative to a central axis of said manifold via said divergent manifold chamber having a dimension $r_2$ relative to said central axis wherein $r_2-r_0 \geqq 2(r_1-r_0)$.

14. The method of claim 13 wherein $r_2-r_0\delta 2.5(r_1-r_0)$.

15. The method of claim 10 wherein the divergent manifold chamber is formed to diverge at an included angle of about 40° to about 90°.

16. The method of claim 15 wherein the included angle is about 64 degrees.

17. A method of making an improved high pressure gas atomizing nozzle having a bore for receiving a melt supply member, comprising the steps of:

a) forming said bore to an initial, undersized, lateral dimension, b) forming a plurality of discrete gas discharge orifices about said bore and intersecting therewith at a given angle, and c) forming the bore to a final, lateral dimension larger than said undersized dimension such that the gas discharge orifices are each at a tangency to said final-dimensioned bore not exceeding about 0.002 inch.

18. The method of claim 17 wherein the said discharge orifices are formed at a tangency to said final-dimensioned bore not exceeding about 0.001 inch.

19. In a high pressure gas atomizing nozzle having a melt supply member for supplying a melt for atomization, the improvement wherein the melt supply member comprises an inner refractory tubular member having a melt supply orifice, and an outer metallic tubular member spaced from the inner refractory body to form a thermal insulating space between the inner and outer members.

20. The combination of claim 19 wherein the inner member includes a lateral, annular flange disposed on an annular shoulder of the outer member proximate an upper end thereof.

21. A high pressure gas atomizing nozzle for atomizing a melt, comprising:

a) a melt supply member, b) a gas manifold for receiving high pressure gas, said manifold comprising a gas inlet in communication with a source of high pressure gas, a divergent first manifold chamber in communication with the gas inlet, and a second manifold chamber in communication with said divergent manifold chamber, said arcuate manifold chamber having an inner radius $r_0$ and an outer radius $r_1$ relative to a central axis of said manifold and said divergent first manifold chamber having a dimension $r_2$ relative to said central axis wherein $r_2-r_0 \geqq 2(r_1-r_0)$, and c) a plurality of discrete gas discharge orifices disposed around the melt supply member and in communication with the manifold for discharging high pressure gas streams to atomize said melt.

22. The nozzle of claim 23 wherein $r_2-r_0\delta 2.5(r_1-r_0)$.

23. In a method of atomizing a rare earth-transition metal alloy melt by supplying high pressure gas to a gas manifold communicating to a plurality of discrete gas discharge orifices disposed about a melt supply member, the improvement comprising supplying the high pressure gas to a gas manifold having a divergent first manifold chamber disposed between a manifold gas inlet and a second manifold chamber communicating to said orifices and having an inner radius $r_0$ and an outer radius $r_1$ relative to a central axis of said manifold, said first manifold chamber having a dimension $r_2$ relative to said central axis wherein $r_2-r_0 \geqq 2(r_1-r_0)$ so as to reduce standing shock wave patterns in said manifold and thereby improve filling of said manifold with the high pressure gas that is discharged from the orifices for atomizing the melt.

24. The method of claim 23 wherein $r_2-r_0\delta 2.5(r_1-r_0)$.

* * * * *